US009051094B2

(12) United States Patent
Brooks

(10) Patent No.: US 9,051,094 B2
(45) Date of Patent: Jun. 9, 2015

(54) CLOSURE WITH OBLIQUELY ANGLED CAM SURFACES ON INNER AND OUTER PARTS

(75) Inventor: John Brooks, Leabrook (AU)

(73) Assignee: Scholle Corporation, Irvine, CA (US)

( * ) Notice: Subject to any disclaimer, the term of this patent is extended or adjusted under 35 U.S.C. 154(b) by 664 days.

(21) Appl. No.: 13/392,852

(22) PCT Filed: Aug. 10, 2010

(86) PCT No.: PCT/AU2010/001013

§ 371 (c)(1),
(2), (4) Date: Aug. 8, 2012

(87) PCT Pub. No.: WO2011/022756

PCT Pub. Date: Mar. 3, 2011

(65) Prior Publication Data

US 2012/0298613 A1 Nov. 29, 2012

(30) Foreign Application Priority Data

Aug. 25, 2009 (AU) ..... 2009904063

(51) Int. Cl.

| | |
|---|---|
| ***B65D 41/62*** | (2006.01) |
| ***B65D 41/34*** | (2006.01) |
| ***B65D 45/32*** | (2006.01) |

(52) U.S. Cl.

CPC ..... *B65D 41/3442* (2013.01); *B65D 45/322* (2013.01); *B65D 2101/0038* (2013.01)

(58) Field of Classification Search

USPC ..... 215/277, 279, 280, 217, 218, 253, 250, 215/254, 274, 201, 273; 220/256.1, 259.5, 220/319, 259.4, 259.3, 320

See application file for complete search history.

(56) References Cited

U.S. PATENT DOCUMENTS 3,893,582 A * 7/1975 Kowalik ..... 215/221

(Continued)

FOREIGN PATENT DOCUMENTS

| | | |
|---|---|---|
| JP | 52-116448 | 3/1977 |
| JP | 61-194644 | 12/1986 |
| WO | 90/00141 | 2/1990 |

*Primary Examiner* — Jeffrey Allen

(74) *Attorney, Agent, or Firm* — The Watson I.P. Group, PLC; Jovan N. Jovanovic; Vladan M. Vasiljevic

(57) ABSTRACT

A closure (22) for a bottle (20) containing carbonated beverages. The closure (22) comprises an inner part (28) and an outer part (24). The inner part (28) is adapted to receive a portion of a finish of the bottle (20) and includes a plurality of outwardly extending first cam surfaces (32) that are obliquely angled to the longitudinal axis of the closure (24). The outer part (24) is adapted to fit substantially over the inner part (28), the outer part (24) including a plurality of inwardly extending second cam surfaces (34) that are obliquely angled to the longitudinal axis of the closure (22). The outer part (24) is movable relative to the inner part (28) between a closed position in which at least a portion of the outer part (24) urges at least a portion of the inner part (28) against the neck to resist disengagement of the inner part (28) from the finish and an open position in which the inner part (28) allows disengagement of the inner (28) part from the finish. When the outer part (24) is in the closed position: applying a longitudinally directed force to the outer part (24), relatively away from the inner part (28), causes the outer part (24) to move longitudinally relative to the inner part (28) towards the open position as the first cam surfaces (32) travel relatively longitudinally away from the second cam surfaces (24); and twisting the outer part in a first direction about the longitudinal axis relative to the inner part (28) drives the inner and outer parts longitudinally towards the open position as the second cam surfaces (34) travel relatively along the first cam surfaces (32).

34 Claims, 17 Drawing Sheets

(56) References Cited

U.S. PATENT DOCUMENTS

| | | | | |
|---|---|---|---|---|
| 4,562,931 | A | | 1/1986 | Brach et al. |
| 5,005,718 | A | | 4/1991 | Buono |
| 5,370,251 | A | | 12/1994 | Buono |
| 5,813,554 | A | * | 9/1998 | Marangoni Graziani et al. ..... 215/274 |
| 5,960,972 | A | * | 10/1999 | Larguia, Sr. ..... 215/274 |
| 6,158,604 | A | | 12/2000 | Larguia, Sr. et al. |
| 6,604,643 | B1 | | 8/2003 | Michael et al. |

* cited by examiner

CLOSURE WITH OBLIQUELY ANGLED CAM SURFACES ON INNER AND OUTER PARTS

FIELD OF THE INVENTION

The present invention relates to a closure for a bottle containing carbonated beverages.

The invention has been primarily developed for use with bottles containing sparkling wine and will be described hereinafter with reference to that application. However, it will be appreciated by persons skilled in the art that the invention is not limited to this particular application and is also suitable for use with bottles containing to other carbonated beverages including sparkling juices, Champagne, ciders and sparkling water.

BACKGROUND OF THE INVENTION

The Applicant's International. PCT Patent Application No. PCT/AU2007/001161 is (Publication No. WO 2008/019443) discloses several embodiments of closures for bottles of carbonated beverages that are an alternative to corks, screw cap closures and synthetic cork replacements. The disclosed closures have an inner part which receives part of the finish of the bottle and an outer part that fits over the inner part. The outer part can be moved, relative to the inner part, between a closed position in which the inner part is securely clamped to the bottle and an open position in which the inner part, and thus the closure, can be removed from the bottle.

In the majority of the embodiments disclosed in the above PCT application, relative movement between the inner and outer parts, along the longitudinal axis of the closure, is required to move the outer part between the two positions. In one embodiment (FIG. 13), relative twisting movement between the inner and outer parts, around the longitudinal axis, is required to move the outer part between the two positions.

It is an object of the present invention to provide an improved closure, particularly in relation to ease and intuitiveness of use, compared to the embodiments disclosed in the above PCT application.

SUMMARY OF THE INVENTION

Accordingly, in a first aspect, the present invention provides a closure for a bottle containing carbonated beverages, the closure comprising:

an inner part adapted to receive a portion of a finish of the bottle, the inner part including a plurality of outwardly extending first cam surfaces that are obliquely angled to a longitudinal axis of the closure; and an outer part adapted to fit substantially over the inner part, the outer part including a plurality of inwardly extending second cam surfaces that are obliquely angled to the longitudinal axis of the closure, the outer part being movable relative to the inner part between a closed position in which at least a portion of the outer part urges at least a portion of the inner part against a neck of the bottle to resist disengagement of the inner part from the finish and an open position in which the inner part allows disengagement of the inner part from the finish, wherein, when the outer part is in the closed position: applying a longitudinally directed force to the outer part, relatively away from the inner part, causes the outer part to move longitudinally relative to the inner part towards the open position as the second cam surfaces travel relatively longitudinally away from the first cam surfaces; and twisting the outer part in a first direction about the longitudinal axis relative to the inner part drives the outer parts longitudinally relatively away from the inner part towards the open position as the second cam surfaces travel relatively along the first cam surfaces.

Preferably, when the outer part is in the open position: applying a longitudinally directed force to the outer part, relatively towards the inner part, causes the outer part to move longitudinally relatively towards the closed position as the second cam surfaces travel relatively longitudinally towards the first cam surfaces whilst simultaneously causing the outer part to twist in a second direction, opposite to the first direction, about the longitudinal axis relative to the inner part as the second cam surfaces travel relatively along the first cam surfaces.

The first cam surfaces are preferably peripherally spaced apart, most preferably equally. The second cam surfaces are preferably peripherally spaced apart, most preferably equally.

The first and second cam surfaces are preferably non-overlapping in the longitudinal direction.

The inner part preferably includes a plurality of outwardly extending third cam surfaces respectively between the first cam surfaces. The outer part preferably includes a plurality of inwardly extending fourth cam surfaces respectively between the second cam surfaces. The third cam surfaces are preferably peripherally spaced apart, most preferably equally. The fourth cam surfaces are preferably peripherally spaced apart, most preferably equally.

The number of first and second cam surfaces are preferably equal. The number of third and fourth cam surfaces are preferably equal. The number of first, second, third and fourth cam surfaces are preferably equal.

In one form, the first, second, third and fourth cam surfaces are straight. In one variation of this form, the third and fourth cam surfaces are parallel to the longitudinal axis. In another variation of this form, the third and fourth cam surfaces are obliquely angled to the longitudinal axis, in a direction opposite to that of the first and second cam surfaces respectively.

In another form, the first, second, third and fourth cam surfaces are curved.

The first direction is preferably counter-clockwise, when viewed from above the bottle and towards the neck of the bottle. The second direction is preferably clockwise.

The first and third cam surfaces are preferably joined end to end around an outer surface on the inner part, most preferably in a substantially continuous saw-tooth configuration. There are preferably 9 equi-angularly spaced first and second cam surfaces.

The second and fourth cam surfaces are preferably positioned around an inner surface on the outer part, most preferably in a substantially spaced apart saw-tooth configuration. There are preferably 9 equi-angularly spaced third and fourth cam surfaces.

The first and third surfaces are preferably angled at about 45 degrees to the longitudinal axis.

The first and third cam surfaces are preferably formed on an inwardly facing ridge. The ridge preferably also includes longitudinally extending stiffening parts. The second and fourth cam surfaces are preferably formed on a plurality of outwardly facing triangular protuberances.

The closure preferably includes an outer surround having a first end connected to the outer part and a second end releasably connected to the neck of the bottle, whereby the connection between the surround and the bottle must be released to allow the outer member to move from the closed position to the open position.

The surround is preferably a tear strip, most preferably manually tearable. The tear strip is preferably spirally wound around the neck of the bottle, most preferably releasing in the second twisting direction.

BRIEF DESCRIPTION OF THE DRAWINGS

Preferred embodiments of the invention will now be described, by way of examples only; with reference to the accompanying drawings in which.

DETAILED DESCRIPTION OF THE PREFERRED EMBODIMENTS

By way of further background, the design of bottles for carbonated beverages such as sparkling wine or Champagne, is relatively standardised and includes: a lower end known as a punt; a substantially cylindrical, relatively wide portion adjacent the punt known as a label panel; an upwardly, inwardly tapering part extending from the label panel known as a neck; and a part known as a finish from the top of the neck to the top of the bottle. The finish includes a wire or muselet bead on its lower end and a crown bead on its upper end. The bottle opening adjacent the crown bead is known as the mouth which communicates with the internal cavity of the bottle via a bore. The wire or muselet bead is often referred to as a CETIE (Centre Technique International de l'Embouteillage et du Conditionnement) band.

Figure 1:
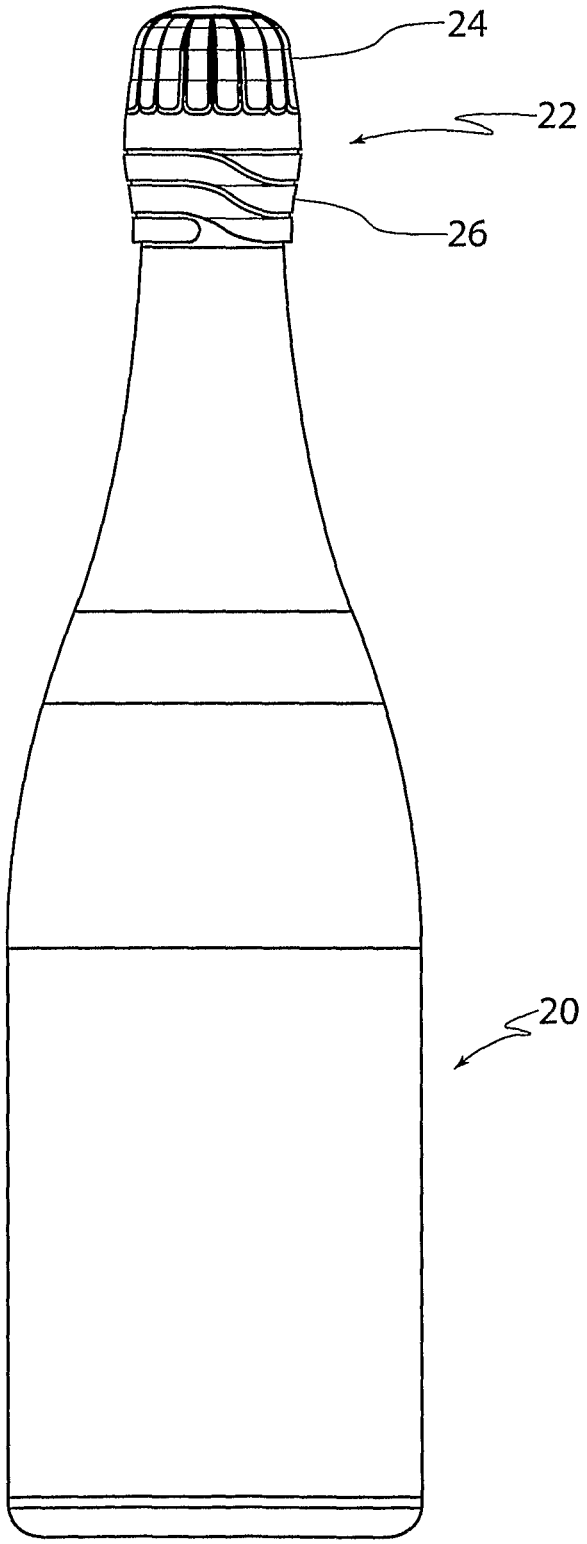
FIG. 1 is a front view of a carbonated beverage bottle to which is applied a first embodiment of a closure.
Figure 2:
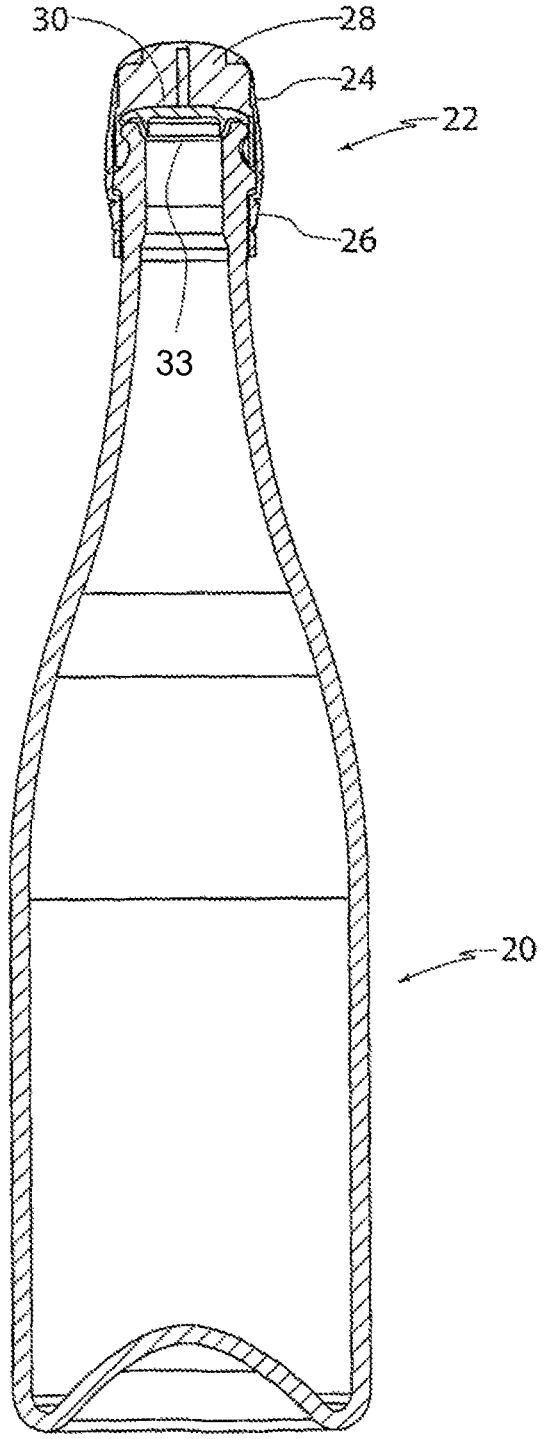
FIG. 2 is a cross-sectional view of the bottle and closure shown in FIG. 1.

FIG. 1 shows a carbonated beverage bottle 20 to which has been applied a first embodiment of a closure 22. The closure 22 includes an outer part 24, a surround in the form of a frangible peelable strip 26 and an inner part 28, the latter being visible in FIGS. 2 and 4. A plug seal 30 and a foil seal 33 are visible in FIG. 2. The outer part 24, the inner part 28, the strip 26 and the plug seal 31 are all formed from a flexible and resilient plastics material, such as low density polyethylene.

Figure 3:
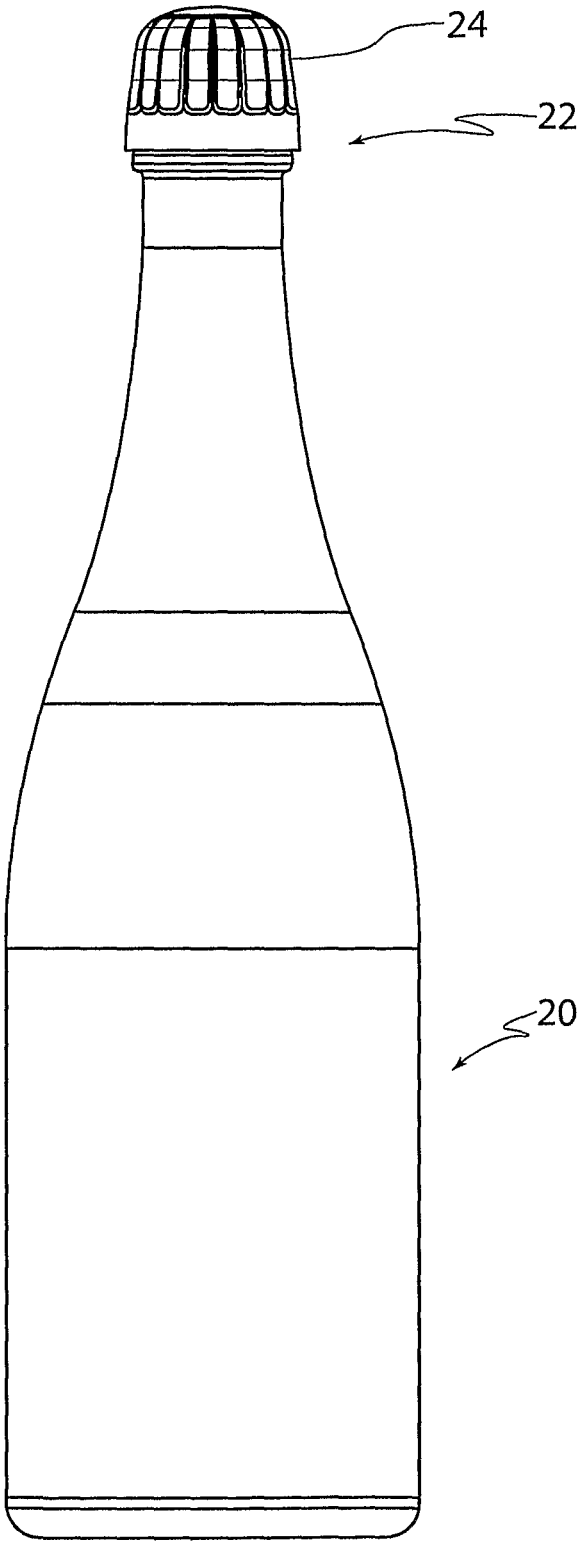
FIG. 3 shows the bottle and closure of FIG. 1 after removal of a surround and with an outer part in a closed position relative to an inner part.

FIG. 3 shows the bottle 20 and, closure 22 after removal of the strip 26 and with the outer part 24 in what will be referred to as a closed position relative to the inner part. As will be described in more detail below, in the closed position a portion of the outer part 24 forces a portion of the inner part 28 into engagement with the finish of the bottle 20.

Figure 4:
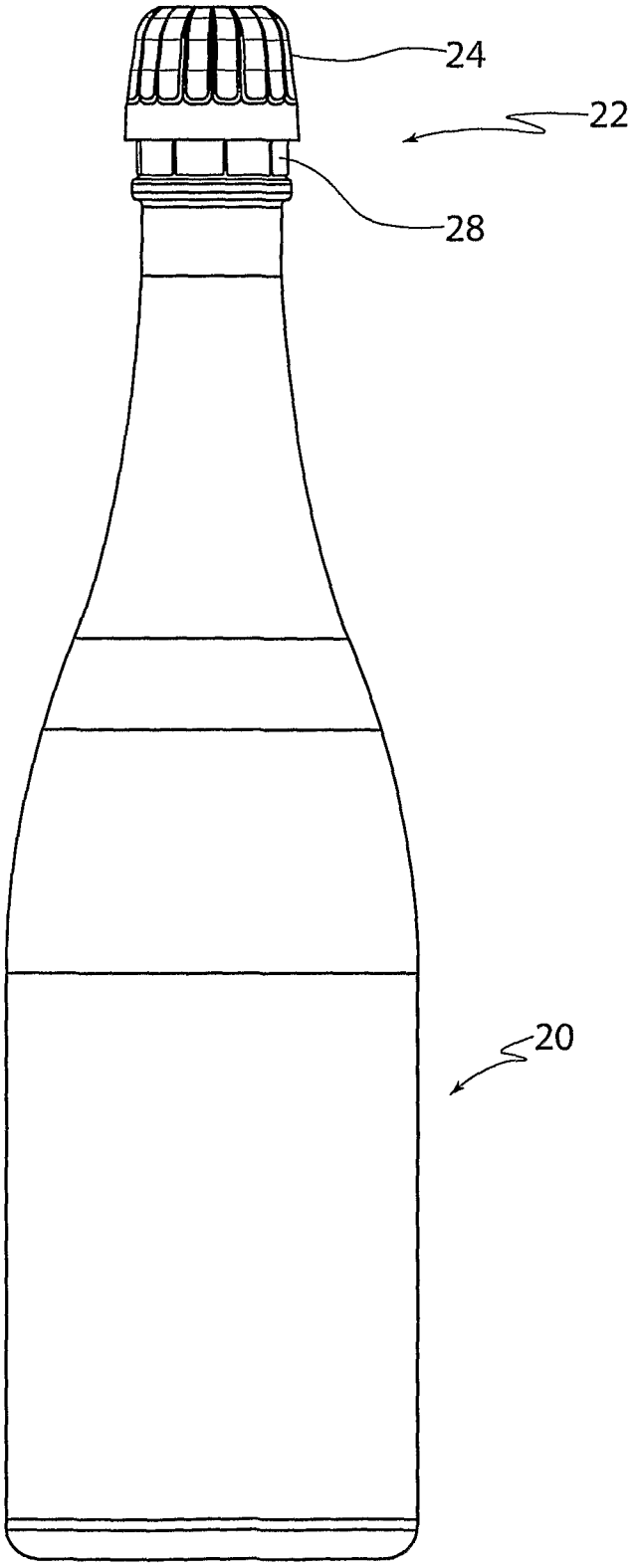
FIG. 4 shows the bottle and closure of FIG. 3 with the outer part in an open position relative to the inner part.

FIG. 4 shows the outer part 24 moved to what will be referred to as an open position relative to the inner part 28. As will also be described in more detail below, in the open position the inner part 28 is no longer forced into engagement with the finish of the bottle 20, allowing the inner part 28 and outer part 24 to be removed.

Figure 5:
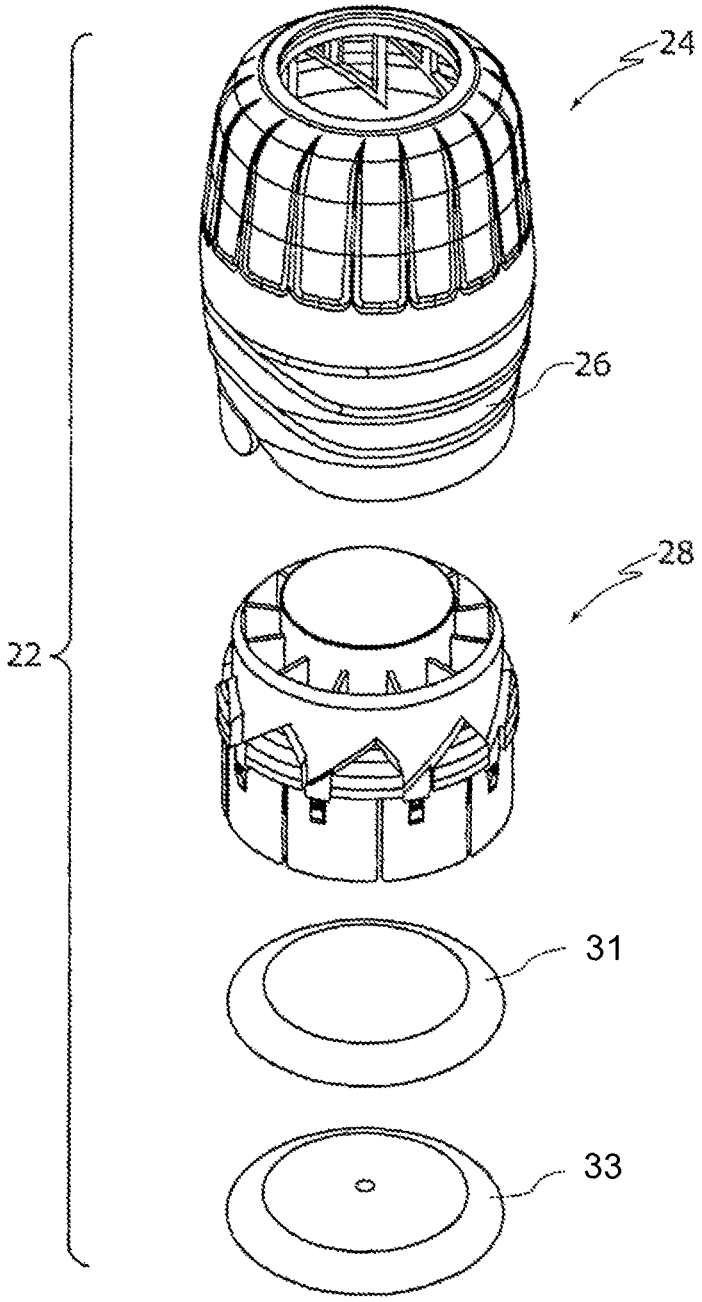
FIG. 5 is an exploded perspective view of the closure shown in FIG. 1.

FIG. 5 shows the components of the closure 22 in more detail.

Figure 6:
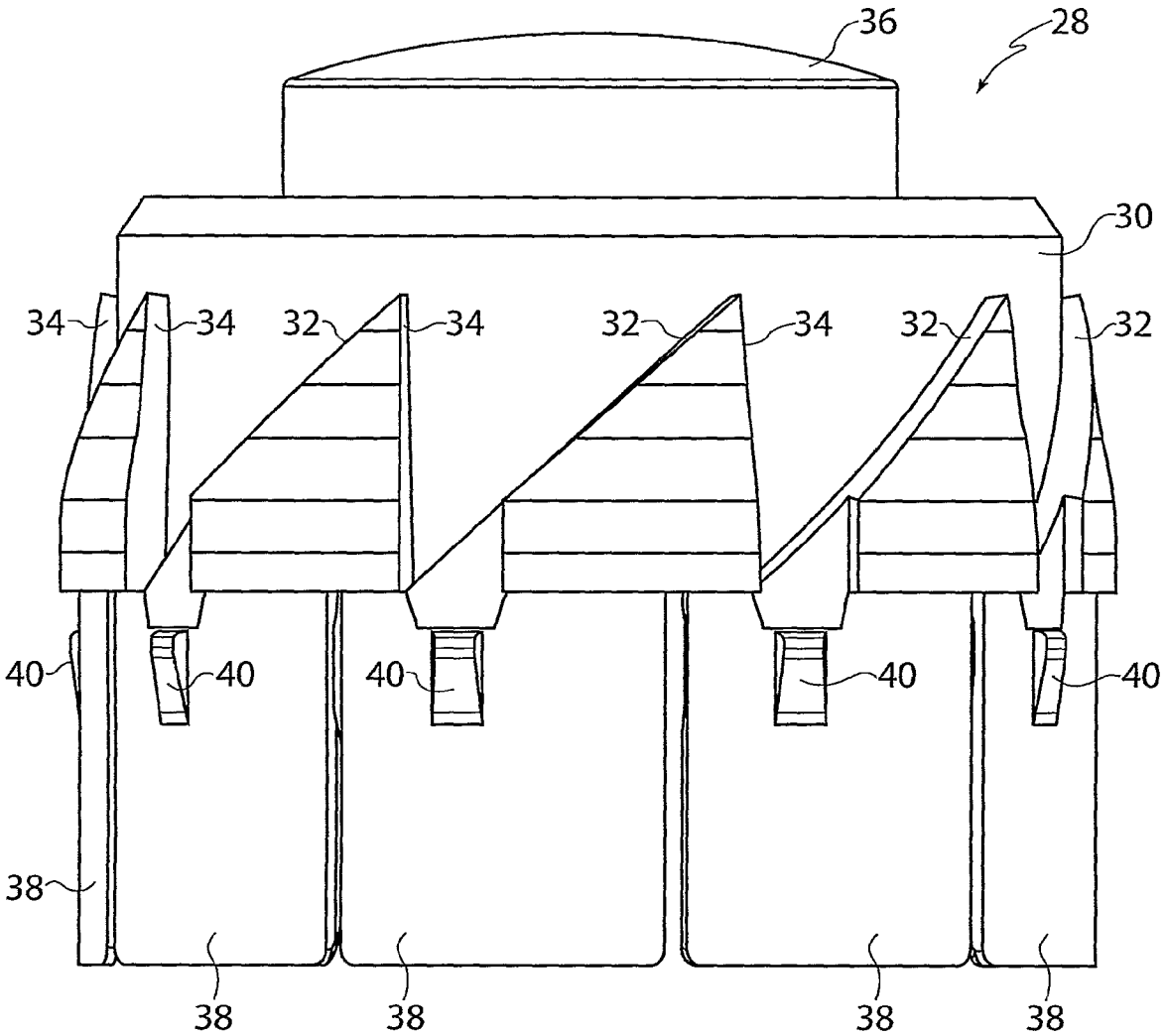
FIG. 6 is a cross-sectional side view of an inner part of the closure shown in FIG. 1.
Figure 7:
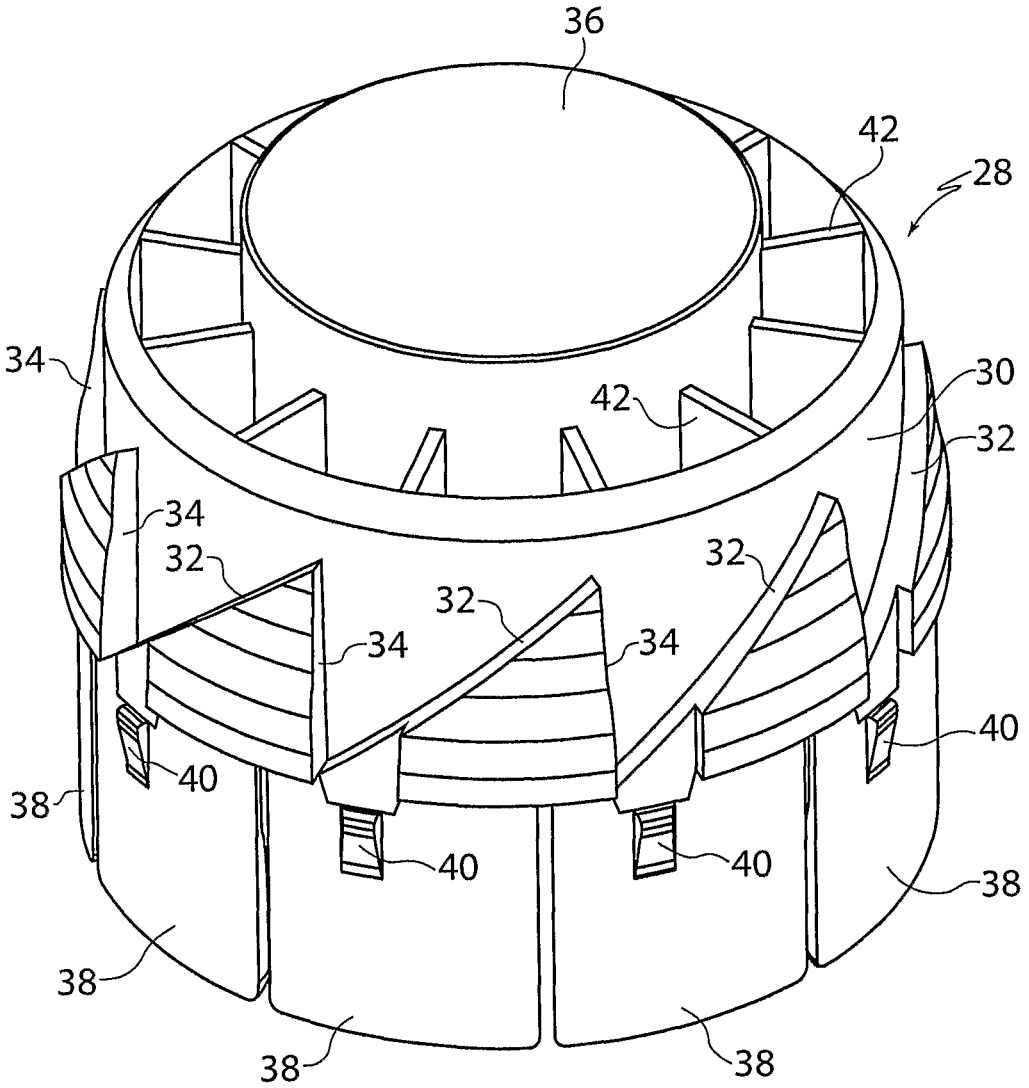
FIG. 7 is an upper perspective view of the inner part shown in FIG. 6.

As best shown in FIGS. 6 and 7, the inner part 28 has a cylindrical body 30 from which nine peripherally spaced apart first cam surfaces 32 outwardly extend. The first cam surfaces 32 are equi-angularly spaced apart around the periphery of the cylindrical body 30 and are each angled at approximately 45° to the longitudinal axis of the closure 22. The upper end of each first cam surface 32 is connected to the lower end of each adjacent first cam surface 32 by nine respective third cam surfaces 34. The third cam surfaces 34 are substantially parallel to the longitudinal axis of the closure. The first 32 and third 34 cam surfaces are thus arranged in a generally spaced apart saw-tooth configuration.

The inner part 28 also includes a cylindrical button 36, nine finish gripping fingers 38 and nine tapered stops 40, the function of these components shall be described below. The fingers 38 each have an inwardly bulbous surface which seats snugly against the finish between the crown seal and the CETIE band and are connected to the body 30 at their proximal end. As best shown in FIG. 7, the cylindrical button 36 is connected to the cylindrical body 30 by a series of thin radial strips 42, in order to minimise weight and material usage whilst maintaining longitudinal strength.

Figure 8:
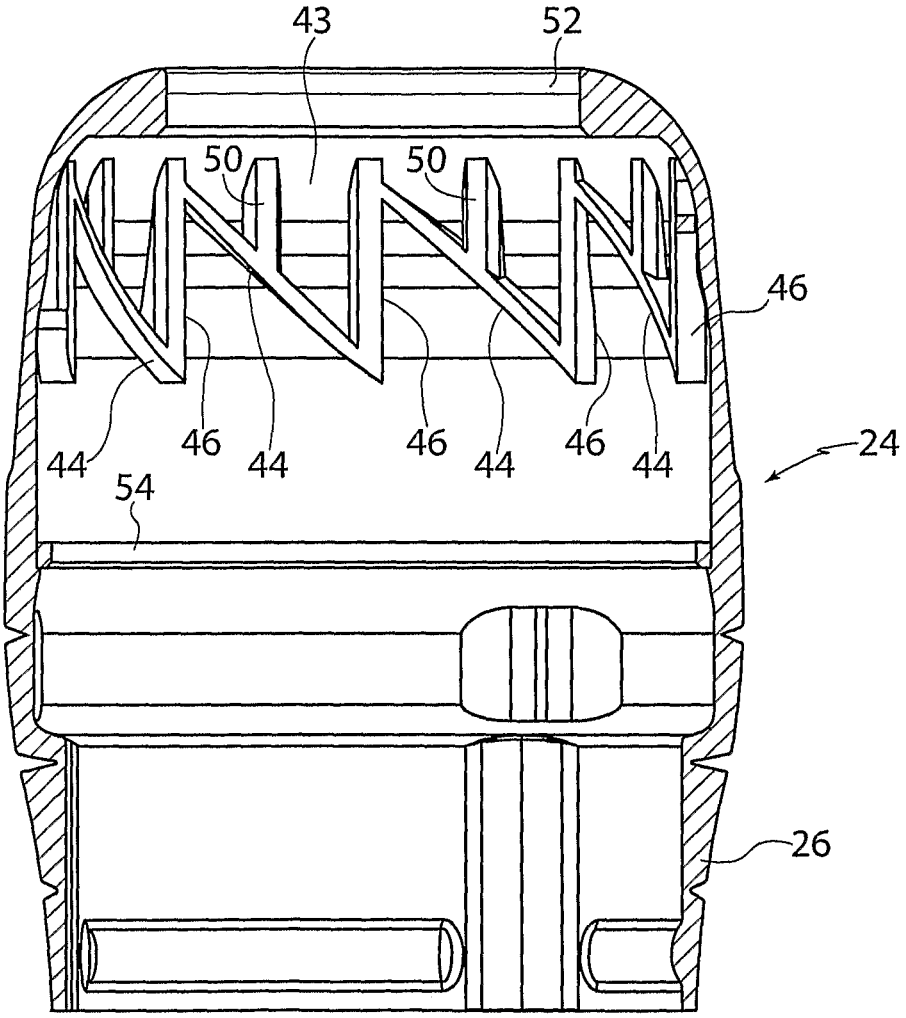
FIG. 8 is a cross-sectional view of an outer part of the closure shown in FIG. 1.
Figure 9:
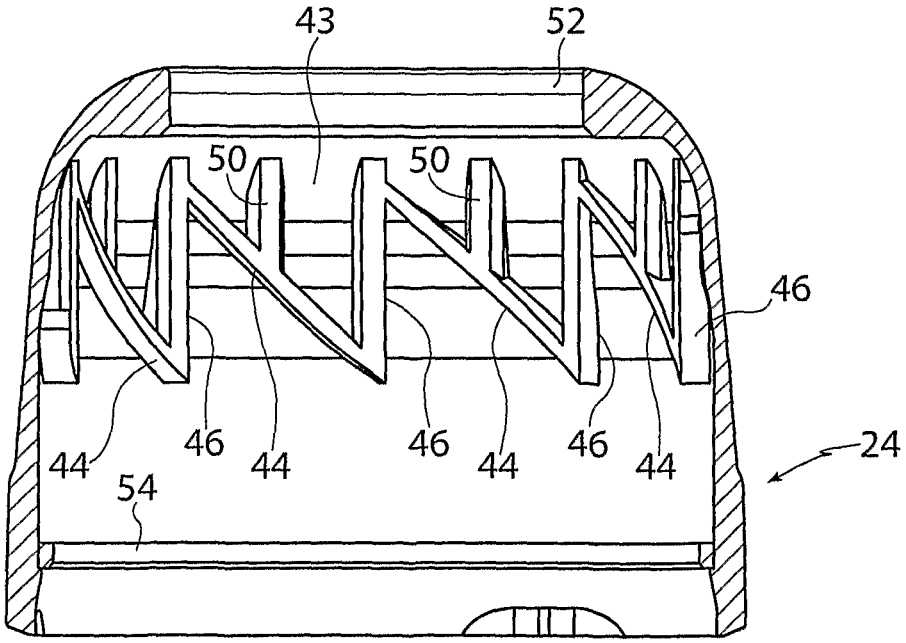
FIG. 9 is a cross-sectional view of the outer part of the closure shown in FIG. 8; after removal of the surround.
Figure 10:
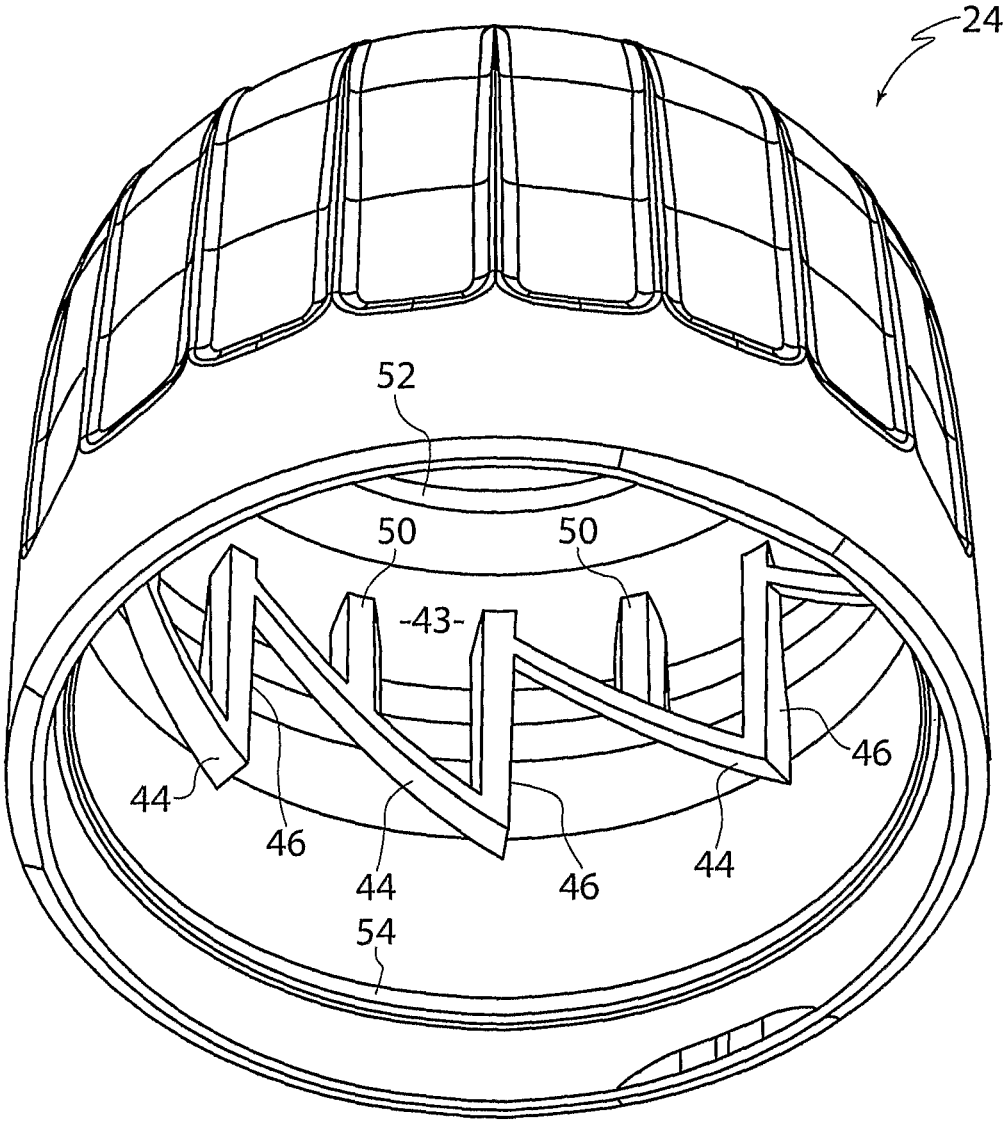
FIG. 10 is an upper perspective view of the outer part shown in FIG. 8.

As best shown in FIGS. 8 to 10, the outer part 24 includes an inner cylindrical surface 43 from which nine peripherally spaced second cam surfaces 44 inwardly extend. The second cam surfaces 44 are angled at approximately 45.degree. to the longitudinal axis of the closure 22. Respective ends of the second cam surfaces 44 are connected by nine fourth cam surfaces 46, which are substantially parallel to the longitudinal axis of the closure 22. The second and fourth cam surfaces 44 and 46 are thus arranged in generally continuous saw-tooth configuration. Longitudinally extending stiffening ribs 50 also extend inwardly from the surface 43.

The outer part 24 also includes a cylindrical opening 52 adapted to receive the button 36 of the inner part 28. The inner part 28 also includes an inwardly facing flange 54, the function of which shall be described below.

The use of the closure 22 will now be described, with particular reference to FIGS. 11 and 12, in which the outer part 24 is only partially shown for clarity and ease of explanation.

Figure 11:
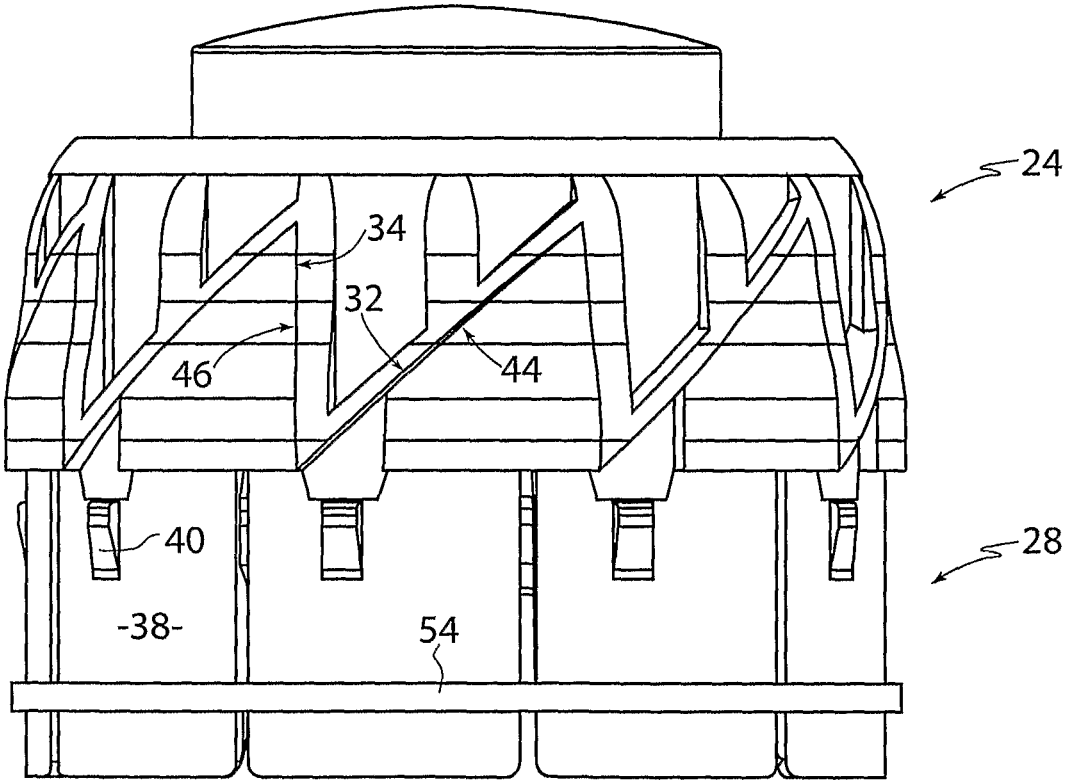
FIG. 11 is a side view of the inner part and a partial side view of the outer part shown in FIG. 8, in the closed position.

FIG. 11 shows the outer part 24 and the inner part 28 in the closed position. In the closed position, the flange 54 presses the finish gripping fingers 38 inwardly to secure the inner part 28, and thus the closure 22, to the bottle 20. Put another way, the flange 54 prevents the fingers 38 from flexing sufficiently outwardly to allow them to pass over the crown bead of the bottle 20.

Figure 12:
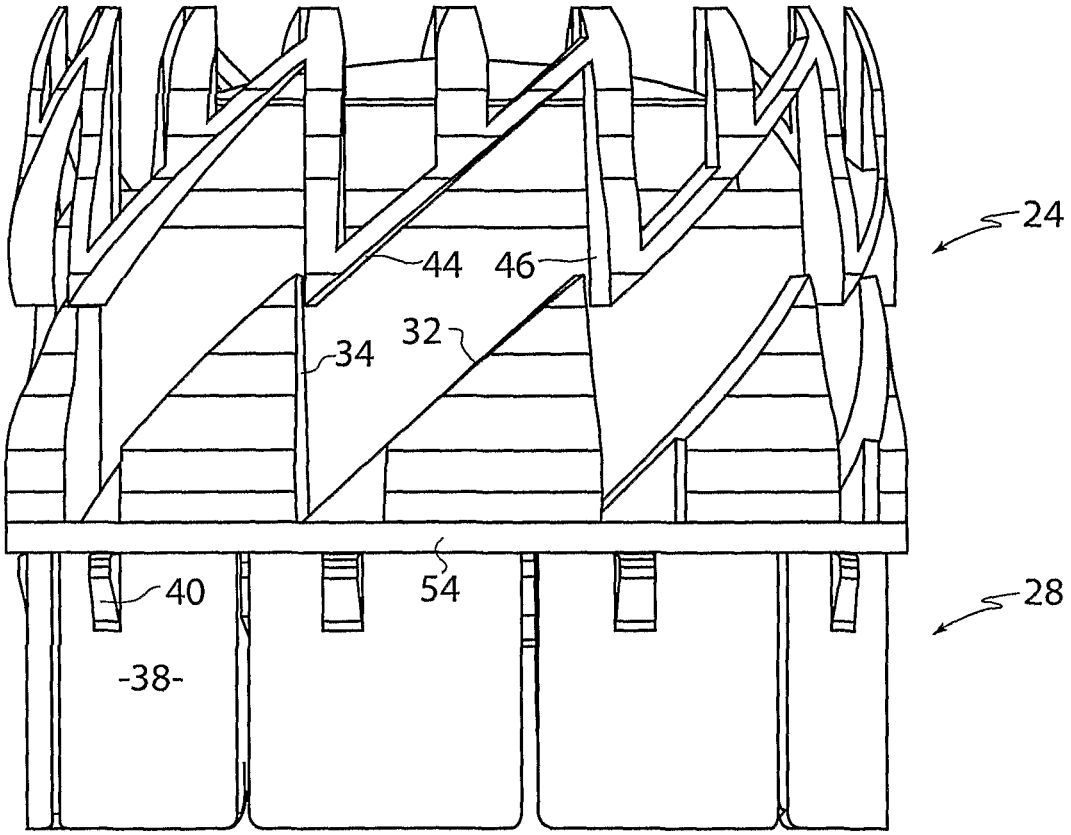
FIG. 12 is a side view of the inner part, shown in FIG. 6 and a partial side view, of the outer part shown in FIG. 8, in the open position.
Figure 13:
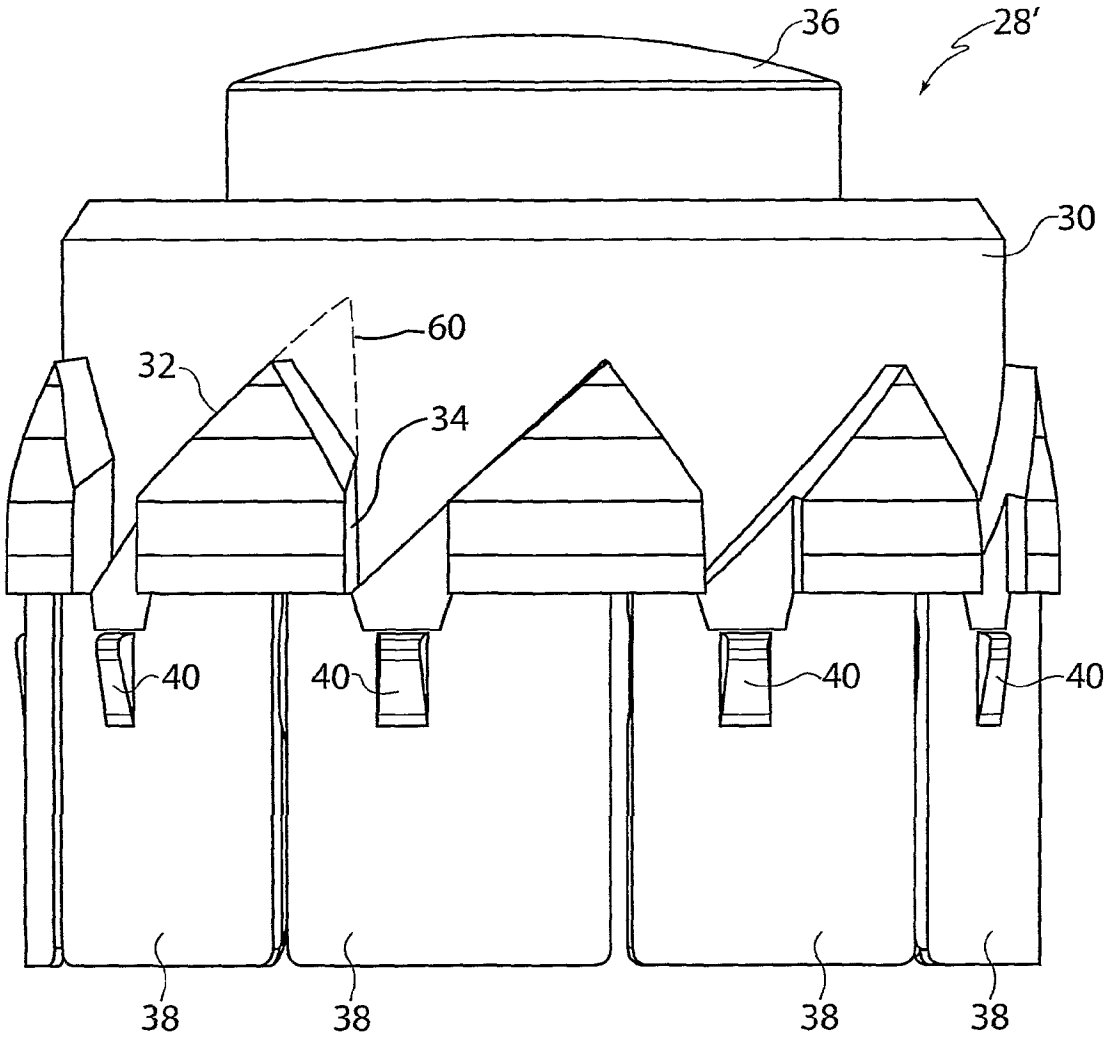
FIG. 13 is a side view of a second embodiment of the inner part.
Figure 14:
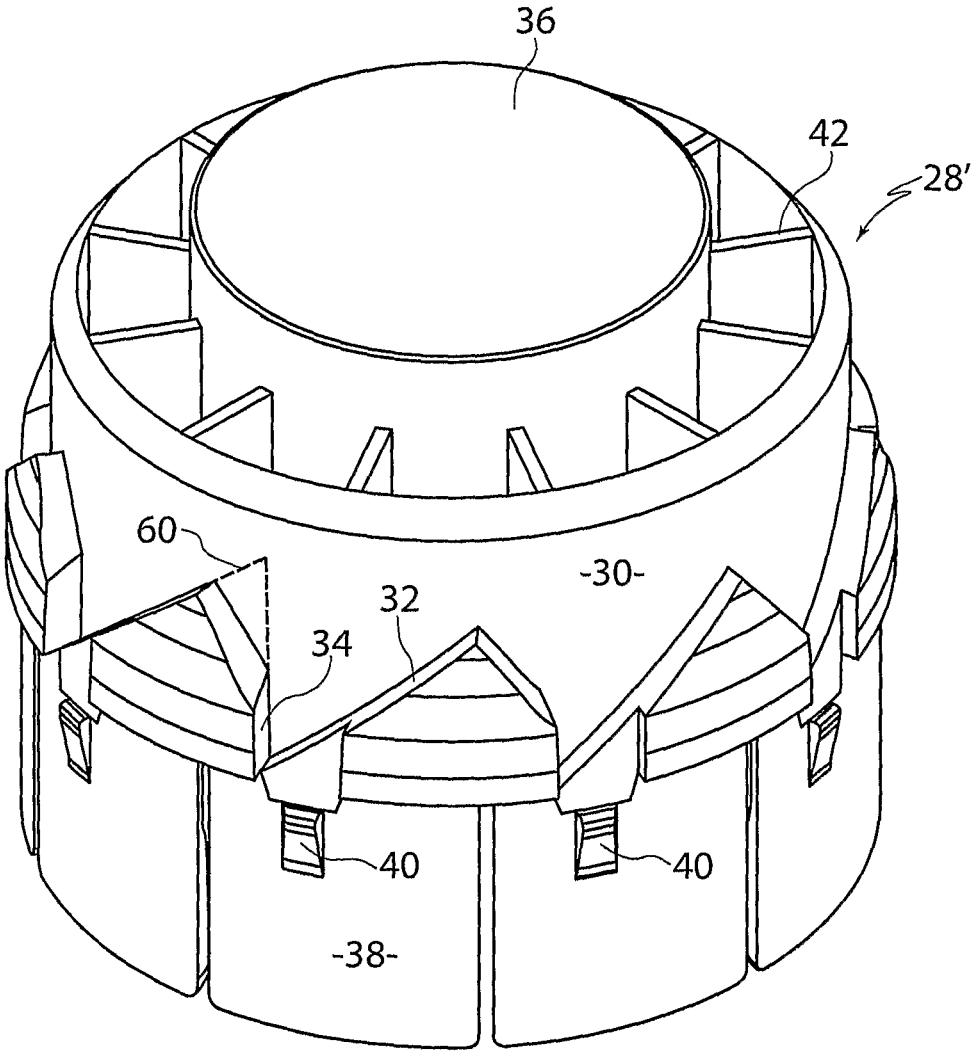
FIG. 14 is an upper perspective view of the inner part shown in FIG. 13.
Figure 15:
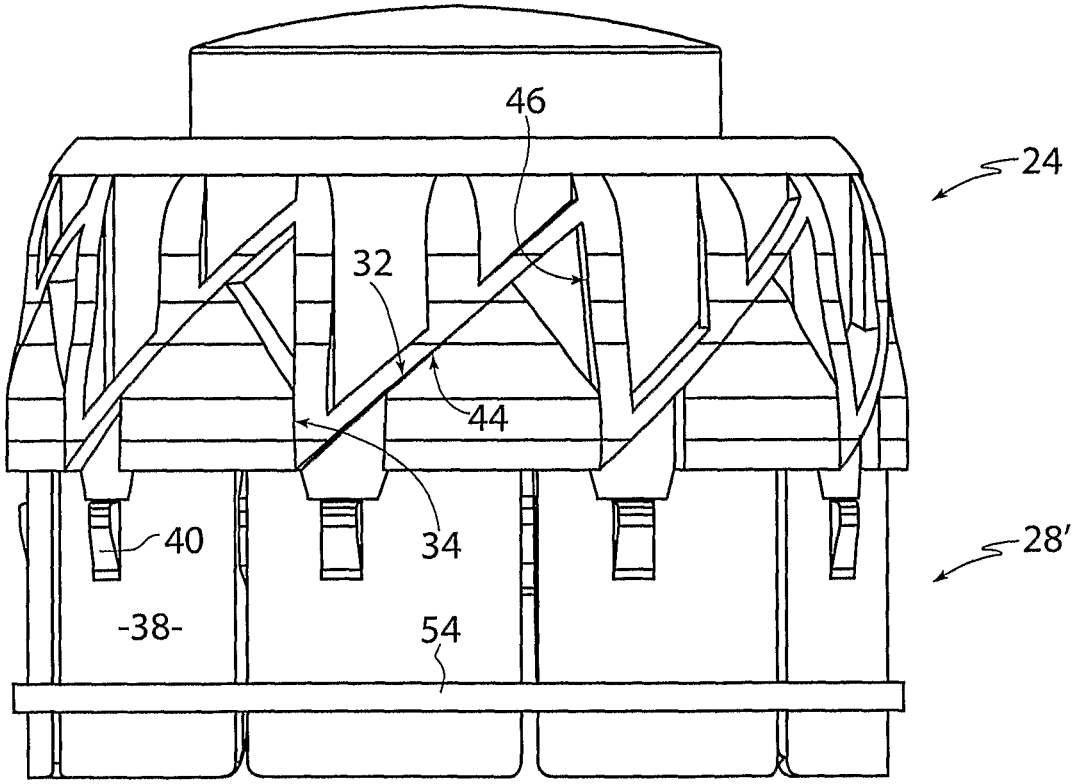
FIG. 15 is a side view of the inner part shown in FIG. 13 and a partial side view with a portion of the outer part shown in FIG. 8, in the closed position.
Figure 16:
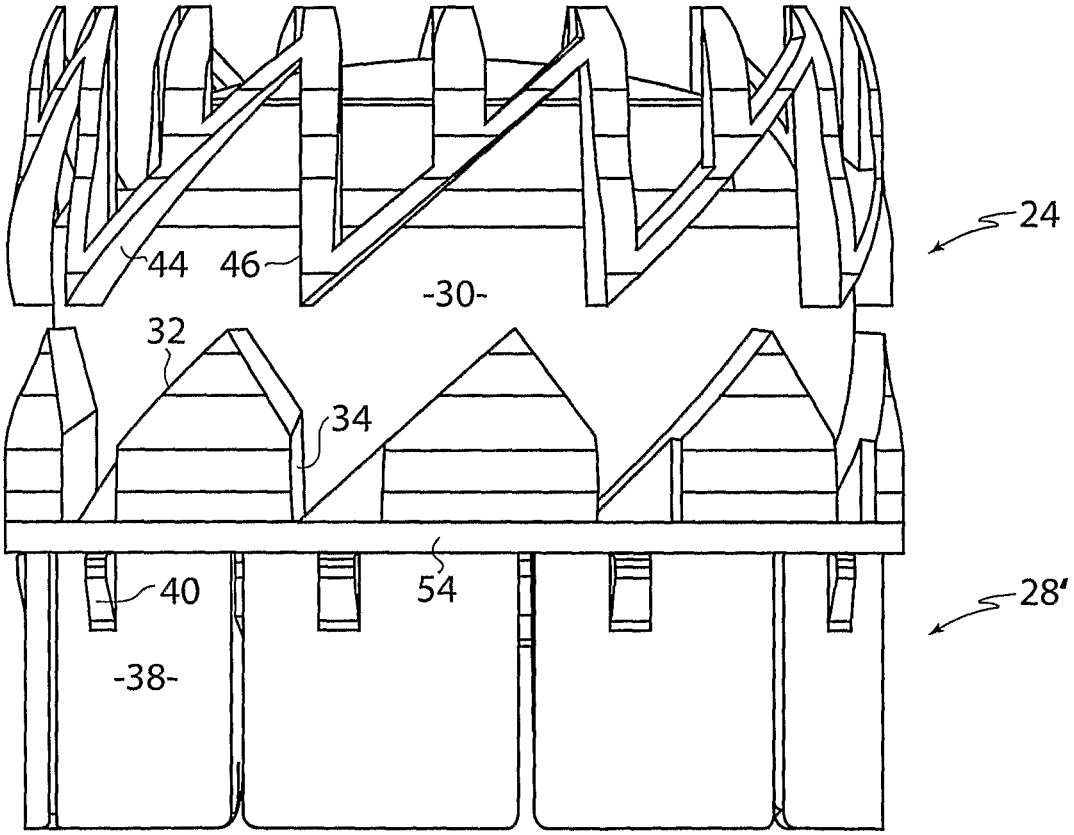
FIG. 16 is a side view of the inner part shown in FIG. 13 and a partial side view of the outer part shown in FIG. 8, in the open position.

FIG. 12 shows the inner part 28 and the outer part 24 in the open position in which the flange 54 has moved away from the fingers 38, therefore allowing them to flex outwardly during removal of the inner part 28 from the bottle 20. In the open position, the flange 54 locates between, the top of the stops 40 and the underside of the cam surfaces 32, 34. This correctly positions the inner and outer parts 24, 28 for re-application to the bottle 20. If the closure 22 is inadvertantly placed in the closed position when removed from the bottle 20, then pushing the button 36 through the opening 52 will return it to the open position, suitable for reapplication to the bottle.

The first and second cam surfaces 32, 44 have a longitudinal dimension of approximately 9 mm each. The outer part 24 travels approximately 8½ mm longitudinally between the open and closed positions. This ensures that the relative positioning of the adjacent pairs of first and second cam surfaces 32, 44 is maintained in both the open and closed positions. Put another way, the inner and outer parts 28 and 24 can only rotate relative to another by a maximum of about 40°.

Bottles of carbonated beverages, such as sparkling wine with a cork closure, are traditionally opened by either of two methods. The first method involves applying a longitudinally directed force to the cork, sometimes accompanied by a slight side-to-side rocking motion. This method is often used to pop and propel a cork from a bottle. The second method is to, when viewed from above and towards the top of a bottle, twist the cork in a counter-clockwise direction relative to the bottle. This method is often used to provide a gentler opening of the bottle, retaining the cork and minimising gas loss. Advantageously, after the strip 26 has been removed, the closure 22 can be moved from the closed position to the open position by either of these methods. In the first (longitudinal) opening method, the movement causes the first cam surfaces 32 and the second cam surfaces 44 to longitudinally separate. In the second (twisting) opening method, the first cam surfaces 32 and the second cam surfaces 44 slide over one another and serve to positively drive the inner part 28 and the outer part 24 from the closed position to the open position. This results in the closure 22 being easy, and importantly intuitive, for a user and provides a significant advantage in terms of customer acceptance of the closure 22, which is, of course, an alternative to the well known cork closure.

Similarly, if a user wishes to reseal the bottle 20, the closure 22 is merely applied to the mouth of the bottle 20 and downward pressure applied to the outer part. This is advantageously also how a cork or other stopper would be reapplied. If the first method has been used to open the bottle 20 and the inner and outer parts 28 and 24 have not been rotated relative to the closed position, then the closure process involves pushing the outer part 24 towards the inner part 28. If the second, twisting, opening method has been used and the inner and outer parts 28 and 24 are rotated relative to the closed position, then the first and second cam surfaces 32, 44 interact during closing to induce a relatively small (no more than 40°) twisting movement in the outer part 24 relative to the inner part 28, and thus the bottle 20, to guide the outer part 24 to the closed position. As will be understood, this allows an untrained user to intuitively open the closure 22 and also reseal the closure 22 without requiring any specific instruction or training. The closure 22 in the closed position is suitable for resealing a bottle of carbonated beverage, after the initial release of pressure that occurs during the initial opening.

As mentioned previously, the strip 26 must first be removed before the outer part 24 can be moved from the closed position to the open position. The strip 26 therefore provides tamper evidence of the bottle 20 not being opened. The strip 26 increases the longitudinal strength and the hoop strength of the closure 22. The strip 26 securely engages the bottle under the CETIE band and provides an additional level of sealing security, sufficient to withstand the initial (relatively high) pressurization of the bottle. The sealing strip 26 is arranged so as to be peeled off (unwound) in a direction opposite to that which causes movement of the outer part 24 from the closed position to the open position, in the second "twisting" opening method, to avoid unintentional twisting release of the closure 22. The release of the strip 26 is also somewhat akin to the removal of the muselet or wire cage that must be performed before removing corks from sparkling wine bottles, again aiding user familiarity and acceptance. It is also important to note that the strip 26 is removed completely from the bottle 20, thereby avoiding an association with products such as soft drinks which often have some type of tamper indicating device retained on the neck of the bottle after removal of, for example, a screw cap closure.

A second alternative embodiment of the inner part 28' will now be described with reference to FIGS. 13-16. Like features to those described in relation to the first embodiment of the inner part 28 are indicated with like reference numerals. The inner part 28' is similar to that previously described except the first and third cam surfaces 32, 34 have been shortened, effectively by removal of the region shown in phantom line 60. This reduces the longitudinal dimension of the first cam surfaces 32 to approximately 7 mm. As a result, the first and second cam surfaces 32, 44 are free of engagement when in the open position, thereby allowing the inner and outer parts 28, 24 to rotate relative to each other in the open position. However, as with the first embodiment, downward pressure on the outer part 24 towards the inner part 28, when in the open position will ultimately cause the first and second cam surfaces 32, 44 to interact with one another and return to the closed position.

Figure 17:
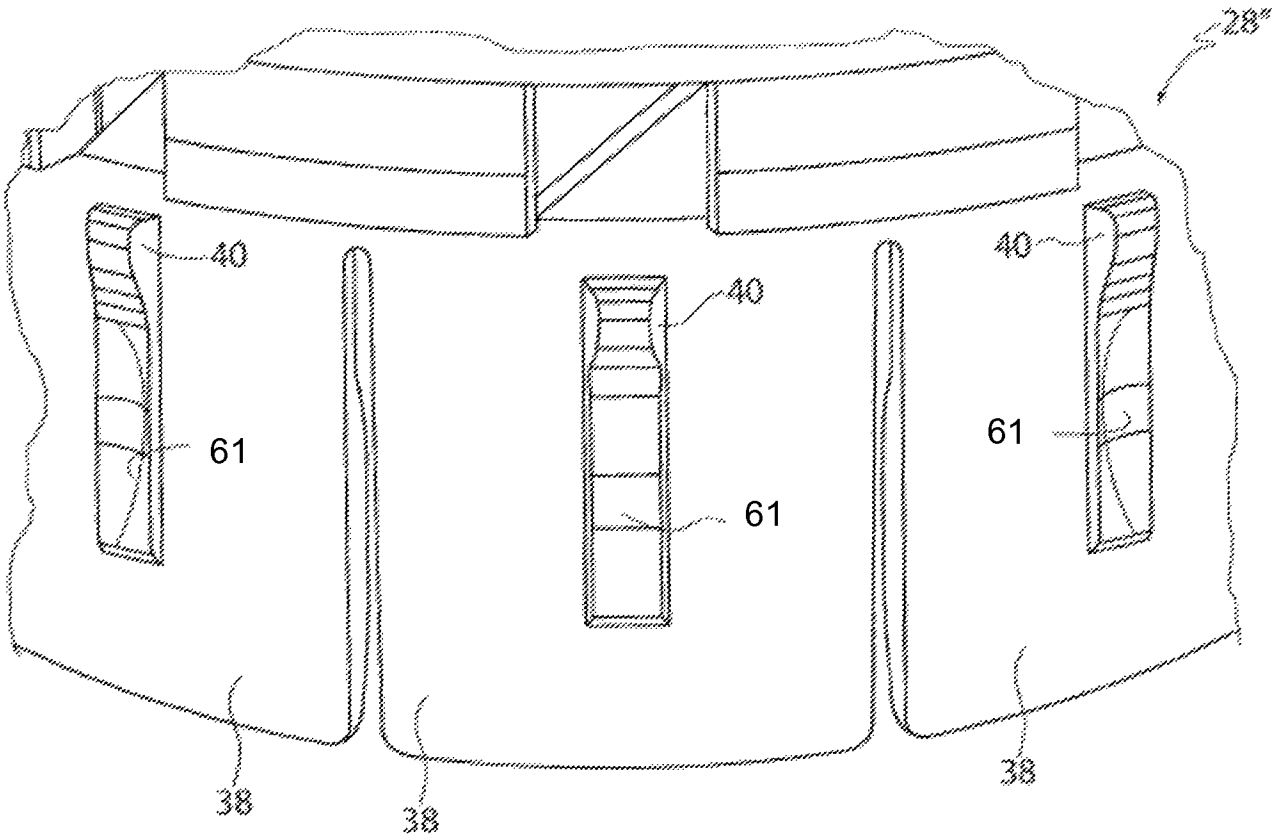
FIG. 17 is a partial upper perspective view of a third embodiment of the inner part.

A third alternative embodiment of the inner part 28" will now be described with reference to FIG. 17. Like features to those described in relation to the first embodiment of the inner part 28 are indicated with like reference numerals. The inner part 28" is similar to that previously described except the stops 40 each have a lengthened lower part 61 which assists in avoiding accidental lifting of the outer part 24 from the inner part 28. Accidental lifting is avoided because the internal lowermost rim of the outer part 24 rests under the lowermost edges of the lower parts 61, when in the closed position. As a result, a force exists between the rim of the outer part 24 and the lower parts 61 which resists the outer part 24 from accidentally lifting up relative to the inner part 28. Put another way, the outer part 24 requires an intentional upward force to release it from the inner part 28 and move it from the closed position to the open position.

The closure 22 is applied to the bottle 20 using conventional bottling equipment as the polyethylene material is sufficiently flexible to be forced over the finish and CETIE band without damage, and resilient enough to return to a snug fit on the finish. In particular, the strip 26 contains spirally directed lines of weakness that will rupture during manual unpeeling removal, but do not rupture during application to the bottle 20.

Although the invention has been described with reference to preferred embodiments, it will be appreciated by persons skilled in the art that the invention may be embodied in many other forms. For example, the direction of the first and second cam surfaces, and also the pull-strip, can be reversed from those previously described. Alternatively, the third and fourth cam surfaces can also be angled in an opposite direction to the first and second cam surfaces. As a further alternative, the first, second and/or third and fourth cam surfaces can be curved. As a third alternative, the cam surfaces can include a notch or similar to provide an indication of the open position being reached. The closure 22 could also be made from other polyolefins, such as polypropylene.

The invention claimed is:

1. A closure for a bottle containing carbonated beverages, the closure comprising:

an inner part adapted to receive a portion of a finish of the bottle, the inner part including a plurality of outwardly extending first cam surfaces that are obliquely angled to a longitudinal axis of the closure; and an outer part adapted to fit substantially over the inner part, the outer part including a plurality of inwardly extending second cam surfaces that are obliquely angled to the longitudinal axis of the closure, the outer part being movable relative to the inner part between a closed position in which at least a portion of the outer part urges at least a portion of the inner part against a neck of the bottle to resist disengagement of the inner part from the finish and an open position in which the inner part allows disengagement of the inner part from the finish, wherein, when the outer part is in the closed position: applying a longitudinally directed force to the outer part, relatively away from the inner part, causes the outer part to move longitudinally relative to the inner part towards the open position as the second cam surfaces travel relatively longitudinally away from the first cam surfaces; and twisting the outer part in a first direction about the longitudinal axis relative to the inner part drives the outer part longitudinally relatively away from the inner part towards the open position as the second cam surfaces travel relatively along the first cam surfaces.

2. The closure as claimed in claim 1, wherein, when the outer part is in the open position: applying a longitudinally directed force to the outer part, relatively towards the inner part, causes the outer part to move longitudinally relatively towards the closed position as the second cam surfaces travel relatively longitudinally toward the first cam surfaces whilst simultaneously causing the outer part to twist in a second direction, opposite to the first direction, about the longitudinal axis relative to the inner part as the second cam surfaces travel relatively along the first cam surfaces.

3. The closure as claimed in claim 1, wherein the first cam surfaces are peripherally spaced apart.

4. The closure as claimed in claim 3, wherein the first cam surfaces are equally peripherally spaced apart.

5. The closure as claimed in claim 3, wherein the second cam surfaces are peripherally spaced apart.

6. The closure as claimed in claim 3, wherein the second cam surfaces are equally peripherally spaced apart.

7. The closure as claimed in claim 1, wherein the inner part includes a plurality of outwardly extending third cam surfaces respectively between the first cam surfaces.

8. The closure as claimed in claim 7, wherein the outer part includes a plurality of inwardly extending fourth cam surfaces respectively between the second cam surfaces.

9. The closure as claimed in claim 7, wherein the third cam surfaces are peripherally spaced apart.

10. The closure as claimed in claim 9, wherein the third cam surfaces are equally peripherally spaced apart.

11. The closure as claimed in claim 8, wherein the fourth cam surfaces are peripherally spaced apart.

12. The closure as claimed in claim 11, wherein the fourth cam surfaces are equally peripherally spaced apart.

13. The closure as claimed in claim 1, wherein the number of first and second cam surfaces are equal.

14. The closure as claimed in claim 8, wherein the number of third and fourth cam surfaces are equal.

15. The closure as claimed in claim 14, wherein the number of first, second, third and fourth cam surfaces are equal.

16. The closure as claimed in claim 8, wherein the first, second, third and fourth cam surfaces are straight.

17. The closure as claimed in claim 16, wherein the third and fourth cam surfaces are parallel to the longitudinal axis.

18. The closure as claimed in claim 16, wherein the third cam surfaces are obliquely angled to the longitudinal axis, in a direction opposition to that of the first and second cam surfaces respectively.

19. The closure as claimed in claim 1, wherein the first direction is counter-clockwise, when viewed from above the bottle and towards the neck of the bottle.

20. The closure as claimed in claim 2, wherein the second direction is clockwise.

21. The closure as claimed in claim 8, wherein the first and third cam surfaces are joined end to end around an outer surface on the inner part.

22. The closure as claimed in claim 21, wherein the first and third cam surfaces are joined end to end around an outer surface on the inner part in a substantially continuous saw-tooth configuration.

23. The closure as claimed in claim 1, wherein there are 9 equi-angularly spaced first cam surfaces and 9 equi-angularly spaced second cam surfaces.

24. The closure as claimed in claim 8, wherein the second and fourth cam surfaces are positioned around an inner surface on the outer part.

25. The closure as claimed in claim 24, wherein the second and fourth cam surfaces are positioned around an inner surface on the outer part in a substantially spaced apart saw-tooth configuration.

26. The closure as claimed in claim 24, wherein there are 9 equi-angularly spaced third cam surfaces and 9 equi-angularly spaced fourth cam surfaces.

27. The closure as claimed in claim 8, wherein the first and third surfaces are angled at about 45 degrees to the longitudinal axis.

28. The closure as claimed in claim 8, wherein the first and third cam surfaces are formed on an inwardly facing ridge.

29. The closure as claimed in claim 28, wherein the ridge also includes longitudinally extending stiffening parts.

30. The closure as claimed in claim 2, wherein the closure includes an outer surround having a first end connected to the outer part and a second end releasably connected to the neck of the bottle, whereby the connection between the surround and the bottle must be released to allow the outer member to move from the closed position to the open position.

31. The closure as claimed in claim 30, wherein the surround is a tear strip.

32. The closure as claimed in claim 31, wherein the tear strip is a manually tearable tear strip.

33. The closure as claimed in claim 31, wherein the tear strip is spirally wound around the neck of the bottle.

34. The closure as claimed in claim 33, wherein the tear strip releases in the second direction.

* * * * *